US010098210B2

(12) United States Patent
Arai

(10) Patent No.: US 10,098,210 B2
(45) Date of Patent: Oct. 9, 2018

(54) LUMINAIRE HAVING A RECEIVER

(71) Applicant: PANASONIC INTELLECTUAL PROPERTY MANAGEMENT CO., LTD., Osaka (JP)

(72) Inventor: Takafumi Arai, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/711,099

(22) Filed: Sep. 21, 2017

(65) Prior Publication Data

US 2018/0092192 A1 Mar. 29, 2018

(30) Foreign Application Priority Data

Sep. 29, 2016 (JP) ..... 2016-192272

(51) Int. Cl.

| | |
|---|---|
| ***F21V 21/00*** | (2006.01) |
| ***H05B 37/02*** | (2006.01) |
| ***F21V 21/02*** | (2006.01) |
| ***F21V 15/01*** | (2006.01) |
| ***F21V 23/04*** | (2006.01) |
| ***F21S 8/00*** | (2006.01) |
| ***F21V 3/04*** | (2018.01) |
| ***F21V 3/06*** | (2018.01) |
| *F21Y 115/10* | (2016.01) |
| *F21V 19/00* | (2006.01) |
| *F21V 21/15* | (2006.01) |
| *F21V 23/00* | (2015.01) |
| *F21V 3/02* | (2006.01) |

(52) U.S. Cl.

CPC ..... *H05B 37/0272* (2013.01); *F21S 8/00* (2013.01); *F21V 3/049* (2013.01); *F21V 3/062* (2018.02); *F21V 15/01* (2013.01); *F21V 21/02* (2013.01); *F21V 23/04* (2013.01); *F21V 23/0435* (2013.01); *H05B 37/02* (2013.01); *F21V 3/02* (2013.01); *F21V 19/001* (2013.01); *F21V 21/15* (2013.01); *F21V 23/005* (2013.01); *F21Y 2115/10* (2016.08)

(58) Field of Classification Search

CPC ..... F21V 21/15; F21V 23/005
USPC ..... 315/190, 191, 217.13; 362/190, 191, 362/217.13

See application file for complete search history.

(56) References Cited

U.S. PATENT DOCUMENTS

| | | | | |
|---|---|---|---|---|
| 7,261,442 | B2 * | 8/2007 | Chiu | F21V 21/15 362/147 |
| 9,338,839 | B2 * | 5/2016 | Recker | H05B 33/0815 |
| 2014/0210346 | A1 * | 7/2014 | Chen | F21K 9/00 315/113 |

FOREIGN PATENT DOCUMENTS

| | | |
|---|---|---|
| JP | 2014-150032 | 8/2014 |

* cited by examiner

*Primary Examiner* — Thuy Vinh Tran
(74) *Attorney, Agent, or Firm* — Greenblum & Bernstein, P.L.C.

(57) ABSTRACT

A luminaire includes: a main body having a placement surface on which a light-emitting module is placed to emit light forward; and a wireless communication module which receives, by wireless communication, a control signal for controlling the light-emitting module. The wireless communication module: includes a substrate, and a transceiver which is provided on the substrate and receives the control signal. The wireless communication module is secured to the main body in such an orientation that the transceiver is located forward of the main body and the substrate intersects the placement surface of the main body.

5 Claims, 9 Drawing Sheets

LUMINAIRE HAVING A RECEIVER

CROSS REFERENCE TO RELATED APPLICATION

This application claims the benefit of priority of Japanese Patent Application Number 2016-192272 filed on Sep. 29, 2016, the entire content of which is hereby incorporated by reference.

BACKGROUND

1. Technical Field

The present disclosure relates to luminaires having a wireless communication function.

2. Description of the Related Art

Luminaires having a wireless communication function are conventionally known. For example, Japanese Unexamined Patent Application Publication No. 2014-150032 (Patent Literature 1) discloses a ceiling light equipped with a wireless communication device that connects to a home energy management system.

SUMMARY

In the aforementioned conventional luminaire, however, there is the risk that communication performance in wireless communication may deteriorate due to the effect of heat generated by a light emitter.

In view of this, the present disclosure provides a luminaire capable of preventing deterioration of communication performance in wireless communication.

A luminaire according to an aspect of the present disclosure includes: a main body having a placement surface on which a light emitter is placed to emit light forward; and a wireless communication unit which receives, by wireless communication, a control signal for controlling the light emitter, wherein the wireless communication unit (i) includes: a substrate; and a receiver which is provided on the substrate and receives the control signal, and (ii) is secured to the main body in such an orientation that the receiver is located forward of the main body and the substrate intersects the placement surface of the main body.

The luminaire according to the present disclosure is capable of preventing deterioration of communication performance in wireless communication.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT

Hereinafter, a luminaire according to exemplary embodiments of the present disclosure will be described in detail with reference to the drawings. It should be noted that each of the subsequently-described embodiments shows a specific example. Therefore, numerical values, shapes, materials, structural components, the arrangement and connection of the structural components, steps, and the sequence of the steps, etc. shown in the following embodiments are mere examples, and are not intended to limit the scope of the present disclosure. Furthermore, among the structural components in the following embodiments, components not recited in any one of the independent claims which indicate the broadest concepts of the present invention are described as arbitrary structural components.

Furthermore, the respective figures are schematic diagrams and are not necessarily precise illustrations. Therefore, for example, the scales, etc. in the respective figures are not necessarily uniform. Furthermore, in the respective figures, substantially identical components are assigned the same reference signs, and overlapping description thereof is omitted or simplified.

Hereinafter, in this written description, "front/forward" refers to the direction in which the luminaire emits light (i.e., light emission direction) and the light extraction direction in which light is extracted, and "back/behind" refers to the direction opposite the "front/forward" direction.

Furthermore, in the written description and the drawings, x-axis, y-axis, and z-axis represent three axes in a three-dimensional orthogonal coordinate system. In each embodiment, the z-axis direction is the vertical direction (upward-downward direction), and a direction perpendicular to the z-axis (direction parallel to an xy plane) is a horizontal direction. It should be noted that the positive direction in the z-axis is vertically downward.

Embodiment

[Outline]

First, the outline of luminaire 1 according to an embodiment will be described with reference to FIG. 1 to FIG. 3.

Figure 1:
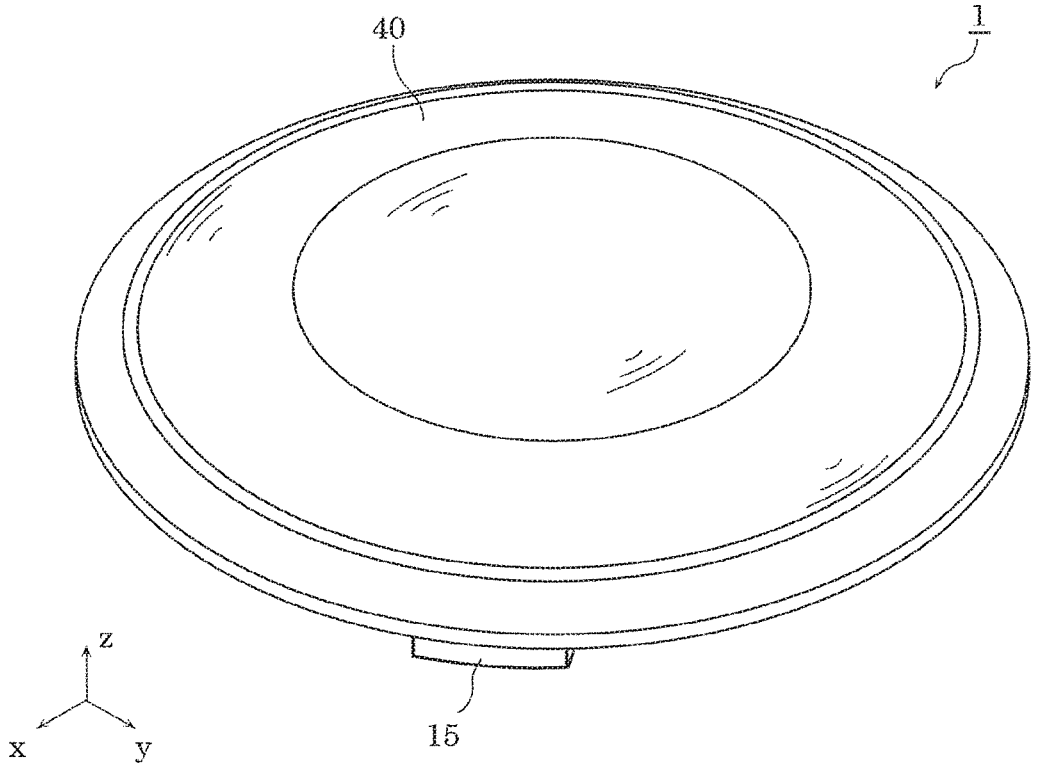
FIG. 1 is a perspective view of a luminaire according to an exemplary embodiment.

FIG. 1 is perspective view of luminaire 1 according to this embodiment. FIG. 2 is an exploded perspective view of luminaire 1 according to this embodiment. FIG. 3 is a perspective view of luminaire 1 according to this embodiment, with cover 40 removed.

Figure 2:
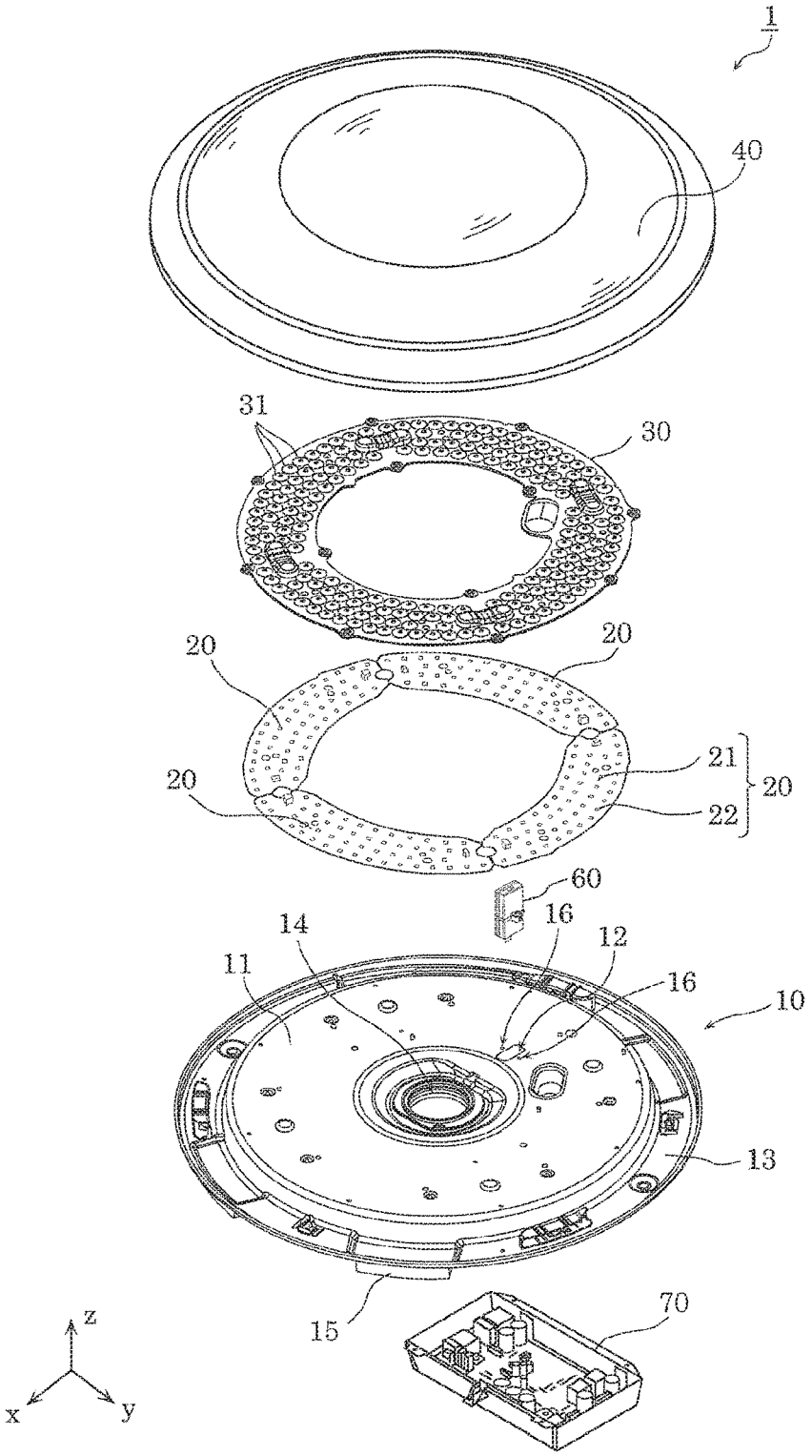
FIG. 2 is an exploded perspective view of the luminaire according to the embodiment.
Figure 3:
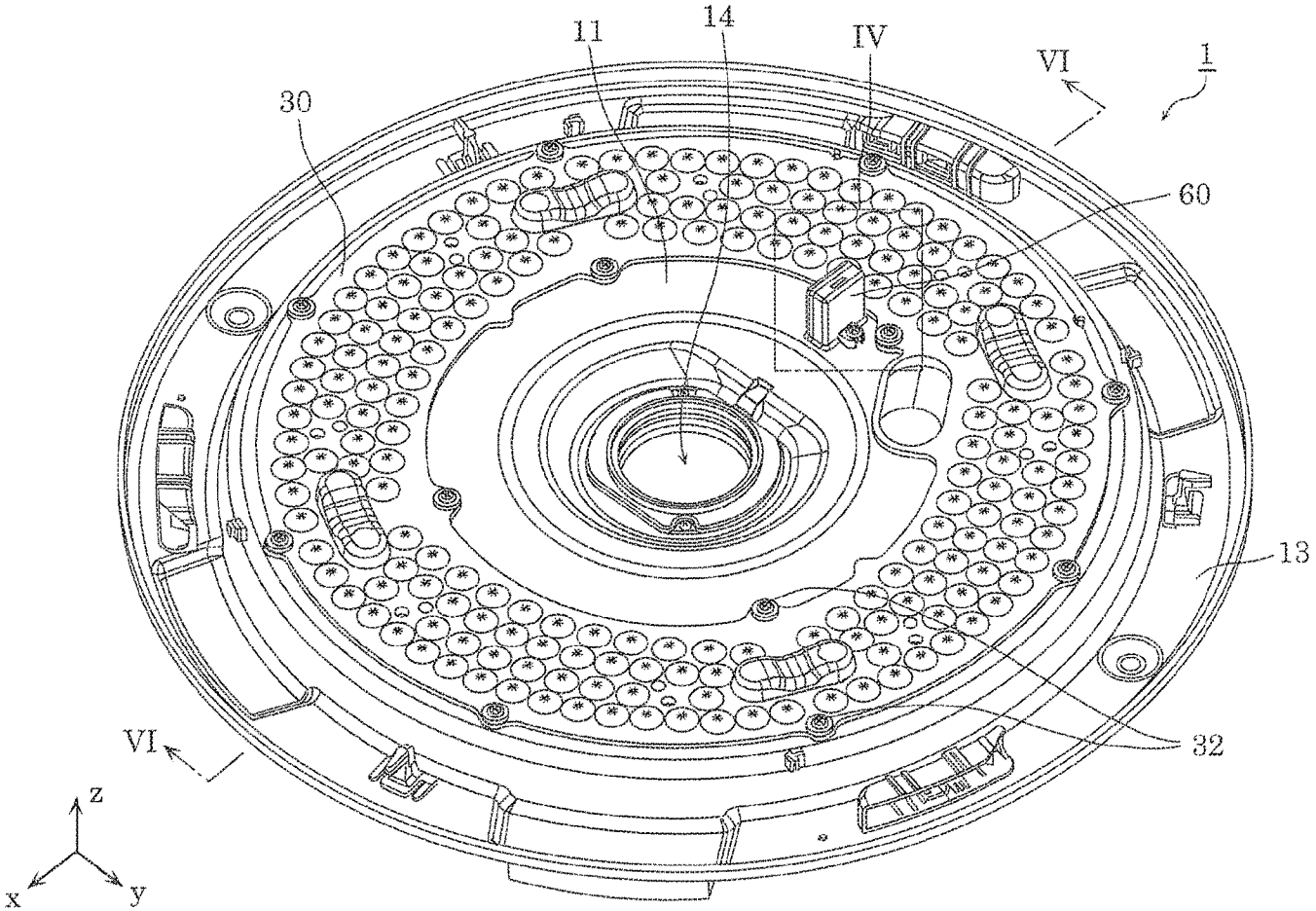
FIG. 3 is a perspective view of the luminaire according to the embodiment, illustrated with cover removed.

Luminaire 1 illustrated in FIG. 1 to FIG. 3 is, for example, installed in a building material of a building such as a house. As an example, luminaire 1 is a ceiling light that is secured to a ceiling of a building, and illuminates a space inside the building. Specifically, luminaire 1 is installed in the ceiling by being attached to a ceiling coupler secured to the ceiling.

As illustrated in FIG. 1 to FIG. 3, luminaire 1 includes main body 10, light-emitting modules 20 (light emitter), light source cover 30, cover 40, resin case 60, and power supply unit 70. Although not illustrated in FIG. 1 to FIG. 3, luminaire 1 further includes wireless communication module 50 housed in resin case 60 (see FIG. 5, etc.).

The respective structural components of luminaire 1 will be described in detail with reference to FIG. 1 to FIG. 3 and using, in addition, FIG. 4 to FIG. 8.

Figure 4:
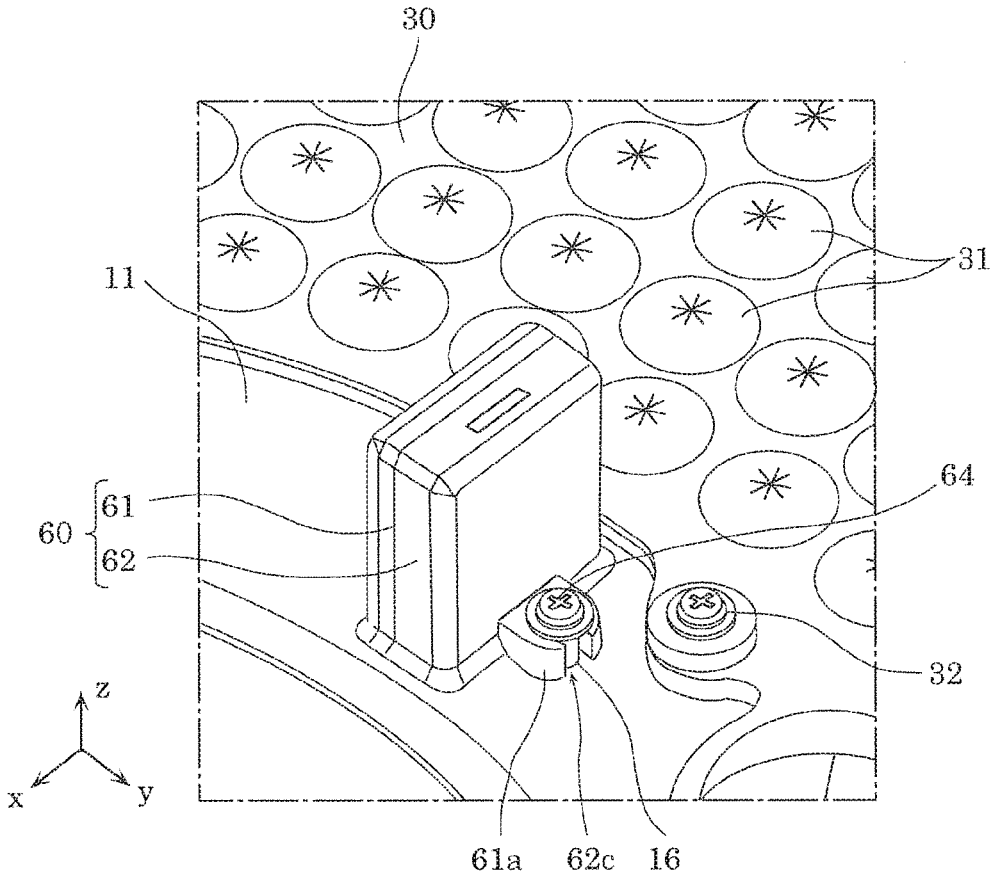
FIG. 4 is a partial enlarged perspective view of the luminaire according to the embodiment, illustrating area IV in FIG. 3.
Figure 5:
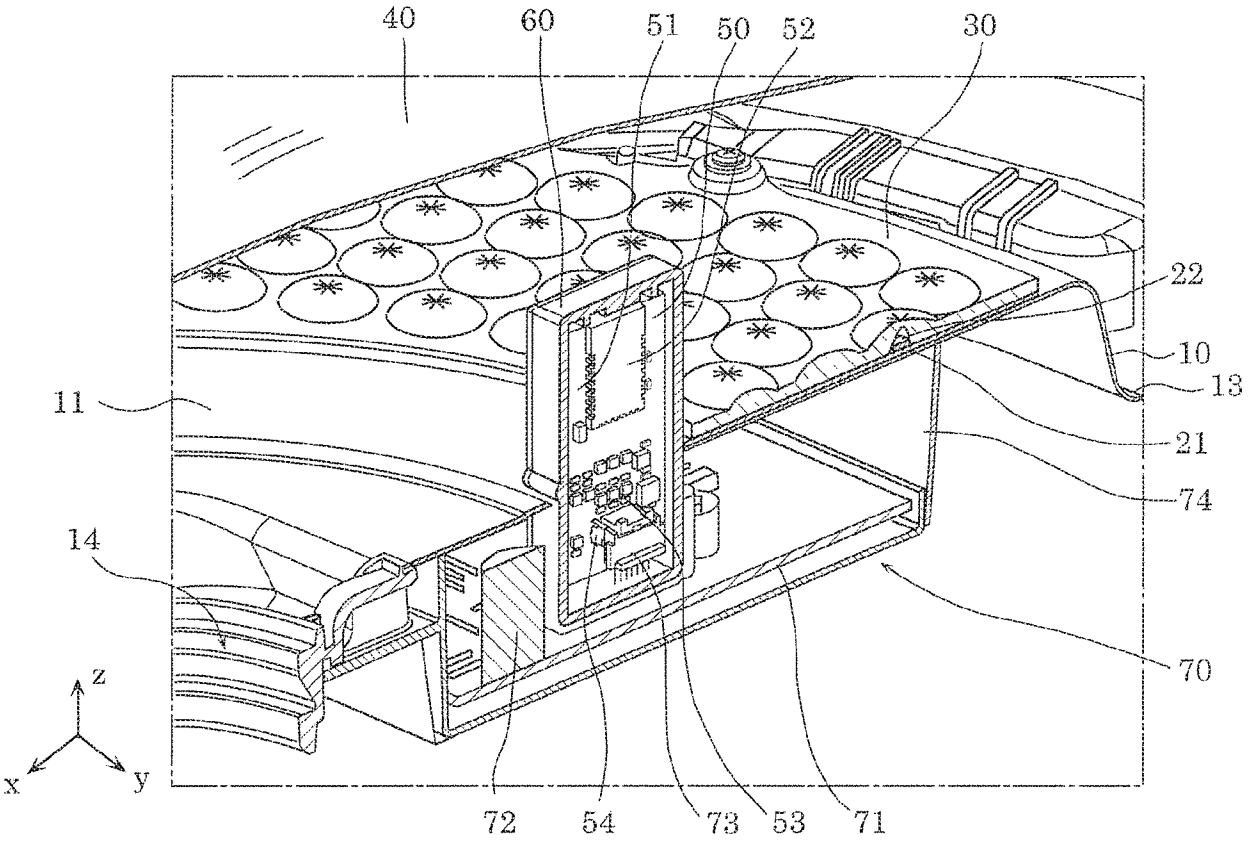
FIG. 5 is a cross-sectional perspective view of area IV of the luminaire according to the embodiment, taken along line VI-VI in FIG. 3.
Figure 6:
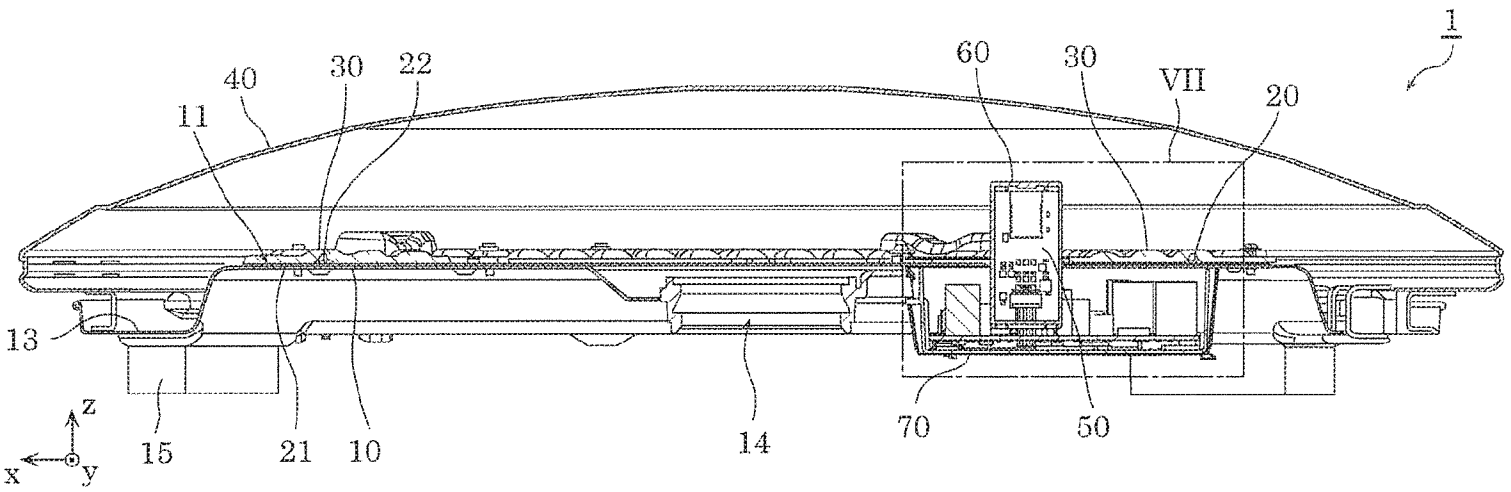
FIG. 6 is a cross-sectional view of the luminaire according to the embodiment, taken along line VI-VI in FIG. 3.
Figure 7:
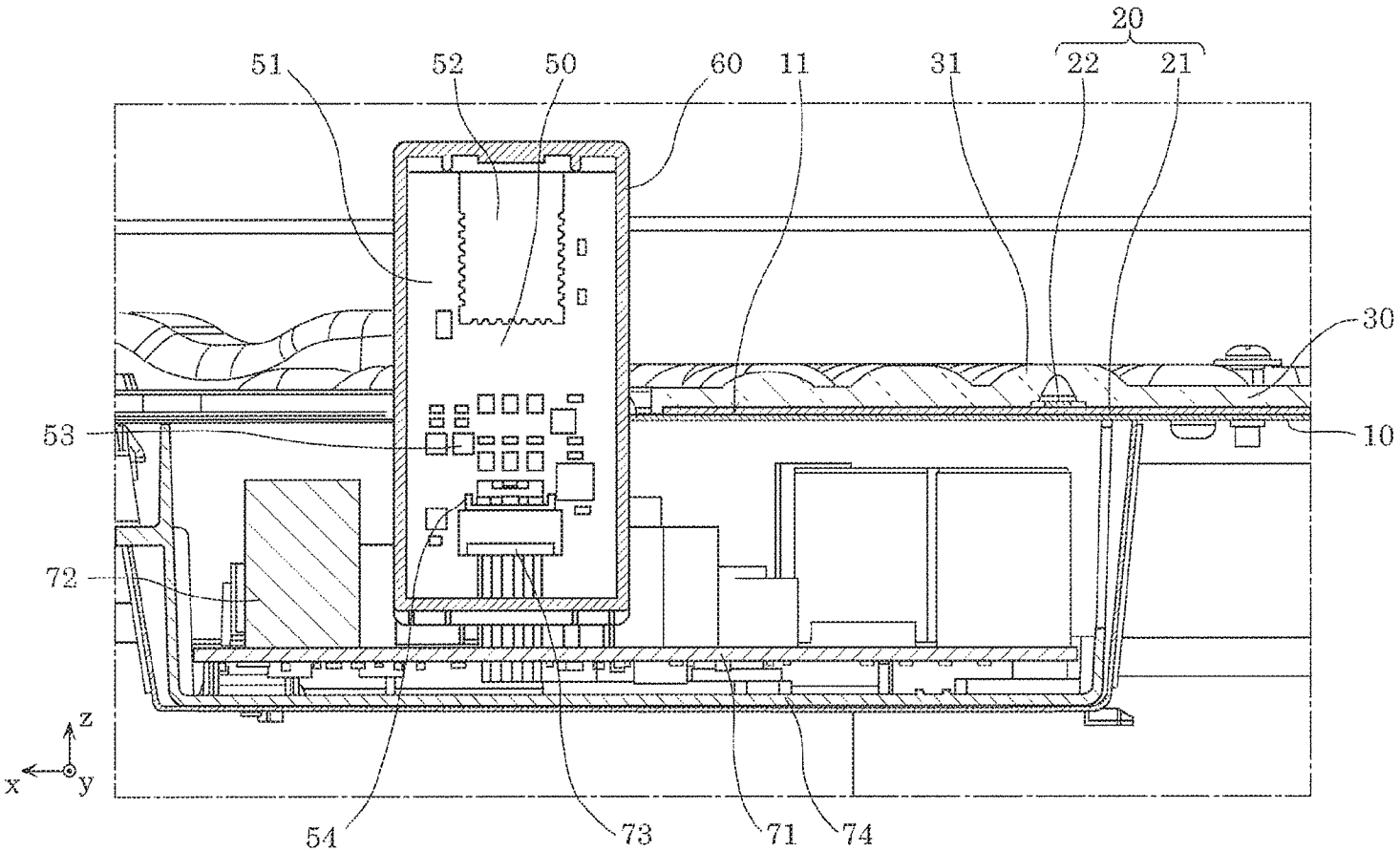
FIG. 7 is a partial enlarged perspective view of the luminaire according to the embodiment, illustrating area VII in FIG. 6.
Figure 8:
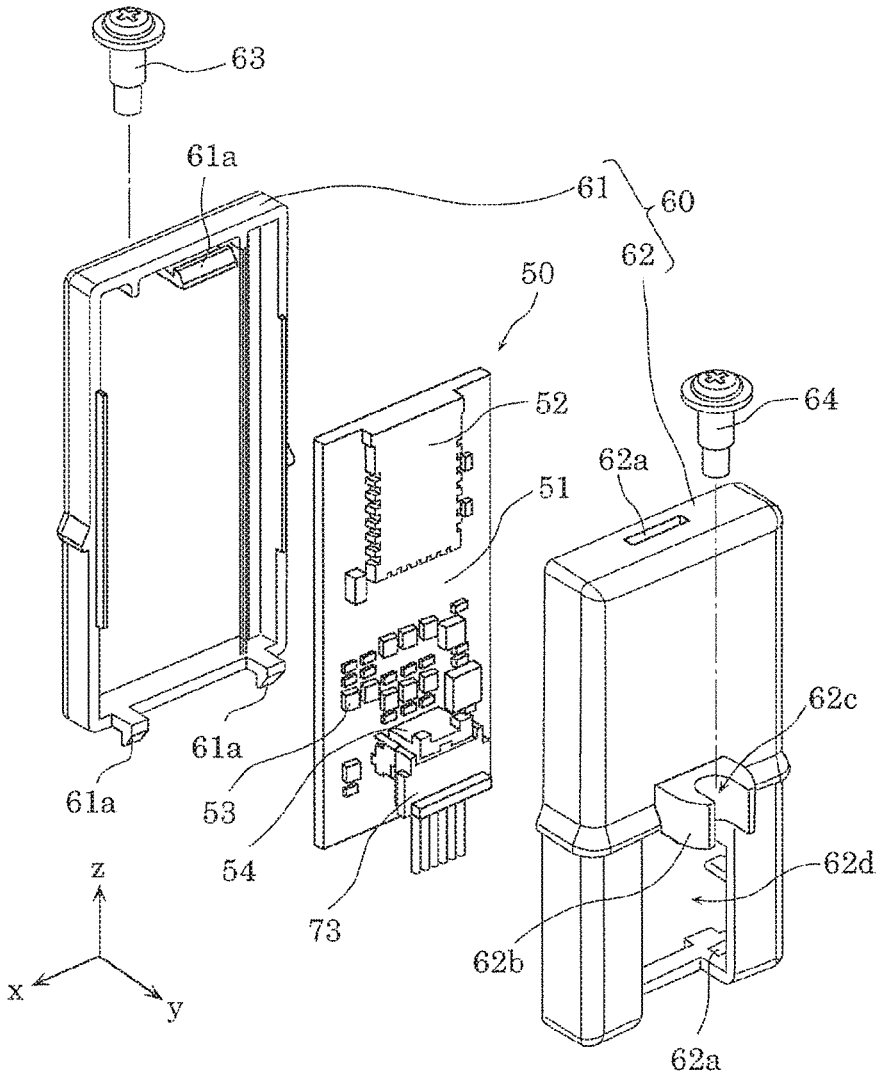
FIG. 8 is an exploded perspective view of a wireless communication module and resin case according to the embodiment.

FIG. 4 is a partial enlarged perspective view of luminaire 1, illustrating area IV in FIG. 3. FIG. 5 is a cross-sectional perspective view of area IV of luminaire 1 taken along line VI-VI in FIG. 3 FIG. 6 is a cross-sectional view of luminaire 1 taken along line VI-VI in FIG. 3. FIG. 7 is a partial enlarged perspective view of luminaire 1, illustrating area VII in FIG. 6. FIG. 8 is an exploded perspective view of wireless communication module 50 and resin case 60 according to this embodiment.

It should be noted that in the respective figures, the z-axis negative side is the ceiling side, and the z-axis positive side is the floor side. Furthermore, in the respective figures, luminaire 1 is illustrated in an upside-down orientation relative to the orientation during normal use to facilitate description.

[Main Body]

Main body 10 is a case that supports light-emitting modules 20. Main body 10 has placement surface 11 on which light-emitting modules 20 are placed so as to emit light forward. Main body 10 supports power supply unit 70. Furthermore, as illustrated in FIG. 3 to FIG. 5, wireless communication module 50 housed in resin case 60 is secured to main body 10.

As illustrated in FIG. 2 and FIG. 3, main body 10 has placement surface 11, through hole 12, periphery portion 13, and through hole 14. In this embodiment, main body 10 has, for example, a flat shape. Specifically, the front view shape of main body 10 is discoid with through hole 14 provided in the middle (i.e., ring-shaped). In a front view (i.e., in a bottom view) of main body 10, placement surface 11 is provided in a ring shape around the entire circumference of through hole 14 so as to surround through hole 14. Periphery portion 13 is provided over the entire circumference of placement surface 11 so as to surround placement surface 11. Cushion material 15, such as urethane, is provided on the backside (ceiling side) of periphery portion 13. An adaptor for attachment to the ceiling coupler is inserted in through hole 14 located in the center.

Placement surface 11 is a floor-side major surface of main body 10, and is a surface on which light-emitting modules 20 are placed. As illustrated in FIG. 5 and FIG. 6, placement surface 11 is positioned forward (i.e., on the z-axis positive side) of periphery portion 13 provided in the shape of a ring along the outer circumference of placement surface 11. With this, a space for housing power supply unit 70 is provided on the reverse side of placement surface 11.

As illustrated in FIG. 2, through hole 12 which penetrates through placement surface 11 is provided in main body 10. Specifically, through hole 12 is a substantially rectangular slit. The bottom view lengthwise direction of through hole 12 runs along the radial direction (specifically, the x-axis direction) of ring-shaped placement surface 11.

Through hole 12 is a hole for inserting wireless communication module 50 and resin case 60. Resin case 60, which houses wireless communication module 50, is inserted substantially perpendicularly in through hole 12. The bottom view shape of through hole 12 and the cross-sectional shape (xy cross-section) of resin case 60 substantially coincide.

Main body 10 is formed using a metal material. In other words, main body 10 is formed using a material that does not transmit wireless signals (radio waves). Specifically, main body 10 is formed into a predetermined shape by pressing sheet metal such as an aluminum sheet or a steel sheet, for example. In order to enhance reflectivity and improve light extraction efficiency, a white paint may be applied or a reflective metal material may be vapor-deposited on a surface on one side of main body 10 (i.e., the surface including placement surface 11).

[Light-Emitting Modules (Light Emitter)]

Light-emitting modules 20 are an example of a light emitter attached to main body 10 of luminaire 1, and emit light of a predetermined color (wavelength) such as white. Light-emitting modules 20 emit light forward (i.e., downward). Light-emitting modules 20 are placed on placement surface 11 of main body 10.

In this embodiment, a plurality of light-emitting modules 20 are provided. Specifically, the light emitter of luminaire 1 includes a plurality of light-emitting modules 20. Specifically, as illustrated in FIG. 2, luminaire 1 includes four light-emitting modules 20 as the light emitter. The four light-emitting modules 20 are placed adjacent to each other so as to be in a ring shape (i.e., a donut shape). The four light-emitting modules 20 have mutually identical configurations. It should be noted that luminaire 1 may include a single ring-shaped light-emitting module as the light emitter.

As illustrated in FIG. 2, FIG. 5, and FIG. 7, each of the plurality of light-emitting modules 20 includes light source substrate 21 and a plurality of light-emitting elements 22.

Light source substrate 21 is a mounting board for mounting the plurality of light-emitting elements 22. Light source substrate 21 is, for example, a printed wiring board, and metal printed wiring is formed into a predetermined pattern on one surface of light source substrate 21 by patterning. As illustrated in FIG. 5 and FIG. 7, light source substrate 21 is placed on placement surface 11 of main body 10 so that light-emitting elements 22 face the floor surface side. The plan view shape formed by light source substrates 21 is, for example, a donut shape of a predetermined width, which is divided into four equal sections. Light source substrates 21 are secured to placement surface 11 of main body 10 using screws (not illustrated in the figures).

Each of light source substrates 21 is, for example, a resin substrate made of an insulating resin material, a metal-based substrate made from a metal material having a surface coated with resin film, a ceramic substrate which is the sintered body of a ceramic material, or a glass substrate made of a glass material. Light source substrates 21 are not limited to being rigid boards, and may be flexible boards. A resist film may be formed on the surface of light source substrates 21, as an insulating film, to cover the metal wire.

Each of light-emitting elements 22 is a semiconductor light-emitting element, such as a light emitting diode (LED), which emits light according to predetermined power. Light-emitting element 22 is, for example, a bare chip that emits monochromatic visible light, and is specifically a blue light-emitting LED chip that emits blue light when power is supplied. A plurality of light-emitting elements 22 are placed on a major surface of each light source substrate 21, in a plurality of rows or in a matrix running along the circumferential direction.

It should be noted that each of the plurality of light-emitting elements 22 is individually sealed by a sealant (not illustrated in the figures). Alternatively, the plurality of light-emitting elements 22 may be collectively sealed on a per element row basis, or all of light-emitting elements 22 on each light source substrate 21 may be collectively sealed.

For example, the sealant includes a light-transmissive resin material such as a silicone resin as a main component, and contains a wavelength converting material that converts the wavelength of the light from light-emitting elements 22. The wavelength converting material is, for example, phosphor particles, and is specifically yellow phosphor particles. In this embodiment, light-emitting modules 20 emit white light through the mixing of the blue light emitted by light-emitting elements 22 and the yellow light emitted by the yellow phosphor particles excited by the blue light. It should be noted that the sealant may contain a light-dispersing material (light-scattering particles) such as silica ($SiO_2$), etc.

It should be noted that light-emitting modules 20 may be a surface mounted device (SMD) modules. Specifically, package-type LED elements (SMD LED elements) may be mounted on light source substrates 21. A package-type LED element includes, for example, a resin container having a cavity, an LED chip mounted inside the cavity, and a sealant (phosphor-containing resin) which is filled into the cavity.

In this embodiment, light-emitting modules 20 may include at least one of a dimming function and a toning function. For example, light-emitting modules 20 emit light of a dimming rate selected from a range from 0% (turned OFF) to 100% (fully turned ON), inclusive. Dimming rate is an example of a parameter indicating light intensity (irradiance). Furthermore, for example, light-emitting modules 20 emit light of a color temperature selected from a range from 2700 K to 6500 K, inclusive. Color temperature is an example of a parameter indicating the tone of light. The instruction for selecting dimming rate and color temperature is included in a control signal which wireless communication module 50 receives.

It should be noted that light-emitting modules 20 may independently emit each of red light (R), green light (G), and blue light (B). Light-emitting modules 20 may control the respective light outputs (i.e., perform RGB control) according to control signals.

[Light Source Cover]

Light source cover 30 is a light-transmissive cover that is light transmissive. As illustrated in FIG. 5 to FIG. 7, light source cover 30 is placed inside cover 40. Light source cover 30 covers light-emitting modules 20.

Light source cover 30 transmits the light emitted by the plurality of light-emitting elements 22 of light-emitting modules 20. In this embodiment, light source cover 30 has a light distribution-controlling function of controlling the distribution of light emitted from light-emitting elements 22.

Specifically, as illustrated in FIG. 2 to FIG. 7, light source cover 30 includes a plurality of lenses 31. The plurality of lenses 31 are provided on a one-to-one correspondence with the plurality of light-emitting elements 22. Lenses 31, for example, increase the light distribution angle of the light from corresponding light-emitting elements 22. In other words, lenses 31 have a function of dispersing light.

As illustrated in FIG. 3 and FIG. 4, light source cover 30 is secured to placement surface 11 of main body 10 using screws 32, so as to cover the inner circumferential portion and outer circumferential portion of each of the plurality of light source substrates 21.

Light source cover 30 is made of a light-transmissive resin material. The material of light source cover 30 is, for example, acrylic (PMMA), polycarbonate (PC), polyethylene terephthalate (PET), or polyvinyl chloride.

It should be noted that, in this embodiment, light source cover 30 is transparent and does not have a light-dispersing property, but is not limited to such. Light source cover 30 may have a light-dispersing property (light-scattering property). By providing a light-dispersing property to light source cover 30, it possible to reduce graininess (luminance unevenness) in the light from light-emitting elements 22. In this case, light source cover 30 has, for example, a milky-white color, and can be formed using a resin material in which light-dispersing particles are dispersed. Furthermore, a milky-white colored light-dispersing film may be formed on the inner surface or the outer surface of light source cover 30, or light-dispersing dots or minute irregularities (texturing) may be formed in light source cover 30.

[Cover]

Cover (globe) 40 is a light-transmissive cover that is light-transmissive. As illustrated in FIG. 1 and FIG. 2, cover 40 is an outer shell cover making up the outer shell of luminaire 1. Cover 40 covers main body 10, light-emitting modules 20, light source cover 30, and resin case 60 (wireless communication module 50). As illustrated in FIG. 2 and FIG. 6, in this embodiment, cover 40 is formed in the shape of a flat dome. Specifically, cover 40 has, on the light emission side (the front), a moderately curved surface (light emission surface) that projects further forward with proximity to the center.

Cover 40 transmits the light emitted by light-emitting elements 22. Specifically, cover 40 transmits the light emitted from light-emitting elements 22 and transmitted by light source cover 30.

Cover 40 is made of a light-transmissive resin material. The material of cover 40 is, for example, acrylic (PMMA), polycarbonate (PC), polyethylene terephthalate (PET), or polyvinyl chloride.

Cover 40 may have a light-dispersing property (light-scattering property). With this, light entering cover 40 can be dispersed (scattered), and light can be extracted substantially uniformly from the entirety of cover 40. In this case, cover 40 has, for example, a milky-white color, and can be formed using a resin material in which light-dispersing particles are dispersed. Furthermore, a milky-white colored light-dispersing film may be formed on the inner surface or the outer surface of cover 40, or light-dispersing dots or minute grains may be formed in cover 40.

Cover 40 is detachably attached to main body 10. There is no particular limitation as to the method of attachment, and cover 40 is, for example, secured by being hooked onto locking components provided in the periphery portion of main body 10. Specifically, cover 40 and main body 10 include mutually engaging locking components and locking receivers, respectively, and are secured together by the engaging of the locking components and the locking receivers.

[Wireless Communication Module (Wireless Communication Unit)]

Wireless communication module 50 is an example of a wireless communication unit which receives, by wireless communication, a control signal for controlling the operation of luminaire 1. The control signal is, for example, a wireless signal transmitted from a portable terminal (operation terminal), such as a remote control or a smart phone, that is operated by a user.

In this embodiment, wireless communication module 50 has a transmitting function aside from a receiving function. For example, wireless communication module 50 transmits the control signal received to another luminaire, etc. Specifically, wireless communication module 50 may relay control signals from the operation terminal to another luminaire. Accordingly, a control signal transmitted from the operation terminal can be received by a luminaire that is far from the operation terminal (i.e., a luminaire that is not located within the communication range of the operation terminal).

Here, wireless communication refers to communication using radio waves (i.e., excluding visible light and infrared light). Wireless communication module 50 performs wireless communication, for example, based on a wireless communication standard such as Wi-Fi (registered trademark), Bluetooth (registered trademark), or ZigBee (registered trademark).

In this embodiment, wireless communication module 50 is electrically connected to power supply unit 70, and receives an illumination control signal for controlling the turning ON or turning OFF of light-emitting modules 20. Wireless communication module 50 may receive an illumination control signal for controlling the dimming or toning of light-emitting modules 20. For example, the illumination control signal includes a turn ON command for turning ON light-emitting modules 20 or a turn OFF command for turning ON light-emitting modules 20, or a command for selecting a dimming rate or a color temperature for light-emitting modules 20, etc.

As illustrated in FIG. 5, FIG. 7, and FIG. 8, wireless communication module 50 includes substrate 51, transceiver 52, controller 53, and connector 54.

Substrate 51 is a printed wiring board, for example, and metal printed wiring (not illustrated in the figures) connecting transceiver-receiver 52 and controller 53 is provided on substrate 51. In this embodiment, substrate 51 is elongated and the shape of its major surfaces is rectangular.

Transceiver 52 is an example of a receiver that receives a wireless signal. In this embodiment, transceiver 52 is, for example, a chip antenna or a pattern antenna, and transmits and receives wireless signals. Specifically, transceiver 52 receives a control signal transmitted from the operation terminal, etc. Furthermore, transceiver 52 may transmit the received control signal.

Controller 53 is a control circuit that processes the control signal received by transceiver 52. Controller 53 includes, for example, at least one circuit element such as an integrated circuit (IC) chip.

Transceiver 52 is provided at a position that is closer to one end in the lengthwise direction of substrate 51. Controller 53 is provided at a position that is closer to the other end in the lengthwise direction of substrate 51. In this embodiment, transceiver 52 and controller 53 are mounted on the same major surface of substrate 51 but may be placed on mutually different major surfaces.

Connector 54 is a component for electrically connecting wireless communication module 50 and power supply unit 70. Connector 54 is, for example, a female connector into which male connector 73 included in power supply unit 70 is inserted. Accordingly, wireless communication module 50 and power supply unit 70 are electrically connected, and a control signal can be transmitted to power supply unit 70.

As can be seen from FIG. 3 to FIG. 7, wireless communication module 50 is secured to main body 10. Specifically, wireless communication module 50 is secured to main body 10 in such an orientation that transceiver 52 is located forward of main body 10 and substrate 51 intersects placement surface 11 of main body 10.

In this embodiment, wireless communication module 50 is inserted in through hole 12 provided in main body 10. For example, as illustrated in FIG. 2, screw holes 16 are provided in the vicinity of through hole 12 of main body 10. By screwing in screws 63 and 64 (see FIG. 8) for securing resin case 60 into screw holes 16, resin case 60 is secured to main body 10.

Wireless communication module 50 is housed in resin case 60, and, as can be seen from FIG. 3, is positioned inward of light-emitting modules 20 provided in a ring shape, in a front view of placement surface 11. Specifically, wireless communication module 50 is positioned between through hole 14 of main body 10 and the inner circumferential portions of light-emitting modules 20 and light source cover 30 provided in a ring shape. At this time, the major surfaces of substrate 51 lie along the radial direction of light-emitting modules 20 that form a ring shape. Specifically, substrate 51 is placed so that the major surfaces are parallel with one of the radial directions extending in straight lines about the center axis (corresponding to the optical axis of luminaire 1) of through hole 14.

Figure 9:
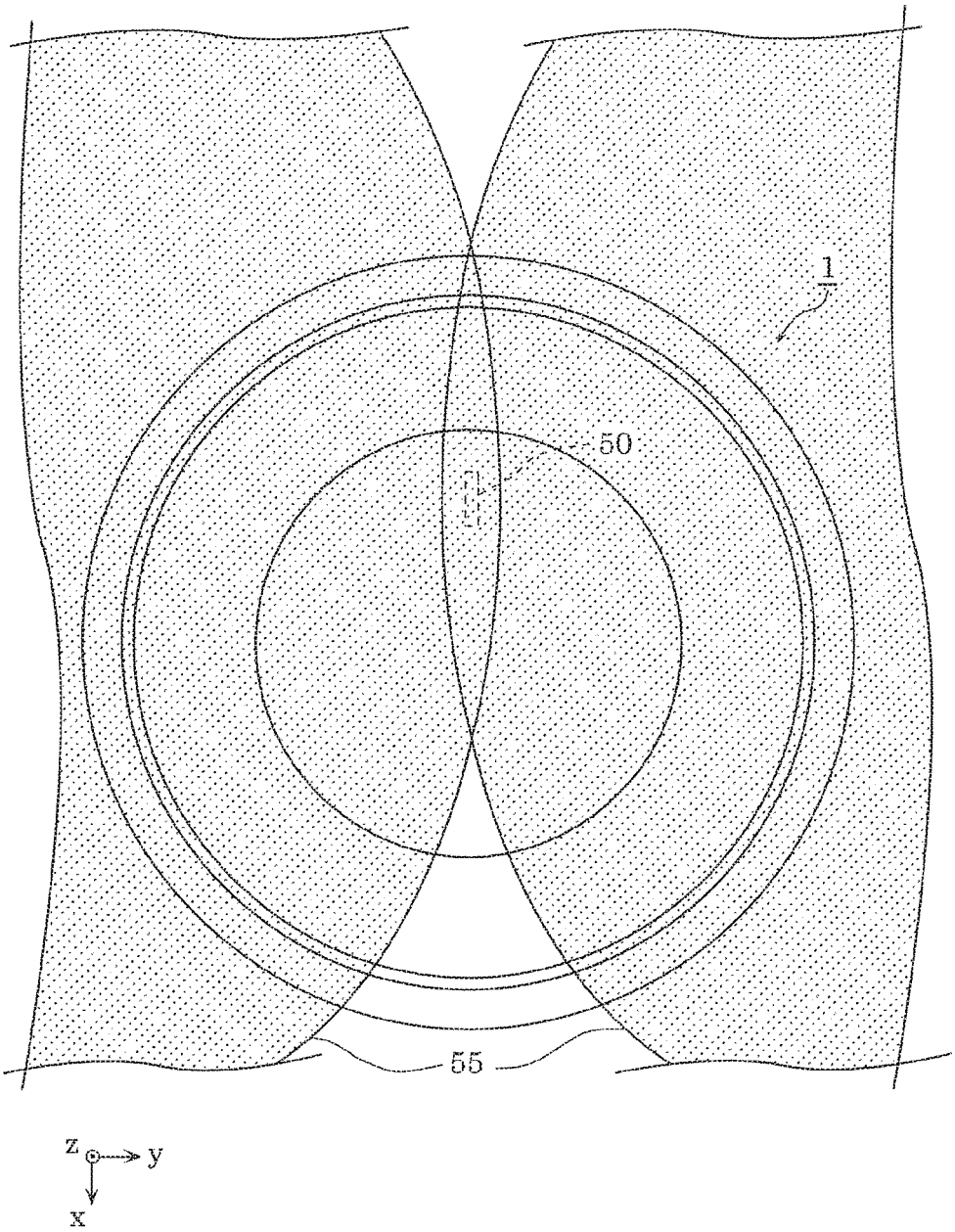
FIG. 9 is a bottom view schematically illustrating communication ranges of the luminaire according to the embodiment.

FIG. 9 is a bottom view schematically illustrating communication ranges 55 of luminaire 1 according to this embodiment. In FIG. 9, communication ranges 55 are schematically illustrated by shading. It should be noted that communication ranges 55 illustrated in FIG. 9 are schematic depictions of communication ranges when wireless communication module 50 is provided independently (i.e., communication ranges according to design specifications), and are communication ranges which do not take into account the effects of other components such as main body 10.

In this embodiment, wireless communication module 50 has directivity in communication ranges 55 for wireless communication. Communication ranges 55 are the ranges within which transceiver 52 of wireless communication module 50 can transmit and receive wireless signals. Specifically, for wireless communication module 50, communication ranges 55 are formed on both sides of substrate 51.

For example, communication ranges 55 extend from respective major surfaces (xz planes) of substrate 51 in a direction orthogonal to the major surfaces (i.e., the y-axis direction), and are barely formed in a direction parallel to the major surfaces (i.e., the x-axis direction). Specifically, transceiver 52 of wireless communication module 50 can transmit and receive wireless signals in a direction orthogonal to the major surfaces of substrate 51. On the other hand, transceiver 52 is barely able to transmit or receive wireless signals in a direction parallel to the major surfaces of substrate 51. The size (maximum distance) of communication ranges 55 is not particularly limited and is, for example, the size of the space (i.e., the room) in which luminaire 1 is installed, and is several meters to several tens of meters.

[Resin Case]

Resin case 60 is a case that internally stores wireless communication module 50. As illustrated in FIG. 8, resin case 60 includes first case 61 and second case 62.

Each of first case 61 and second case 62 is a flat substantially rectangular parallelepiped-shaped (tray-shaped) box having an open major surface. First case 61 and second case 62 are put together by matching up their respective open major surfaces, with wireless communication module 50 being disposed therebetween. First case 61 and second case 62 are secured to each other by engaging claws 61*a* provided in one of them with recesses 62*a* provided in the other.

As illustrated in FIG. 8, second case 62 has projection 62*b* in which cutout-like through hole 62*c* is provided. As illustrated in FIG. 4, second case 62 is secured to main body 10 by screwing in screw 64 into a corresponding screw hole 16 provided in main body 10, via through hole 62*c*.

Although not illustrated in FIG. 8, first case 61 likewise has a projection provided with a cutout-like through hole through which screw 63 is inserted.

Opening 62*d* is further provided in second case 62. Opening 62*d* is provided for exposing connector 54 of wireless communication module 50. This enables connector 73 to be inserted into connector 54 in the state where wireless communication module 50 is housed inside resin case 60.

In this embodiment, resin case 60 is light-transmissive. Specifically, resin case 60 is transparent to the white light (visible light) emitted from light-omitting modules 20.

Resin case 60 is formed using, for example, a transparent resin material such as acrylic, polycarbonate, etc. Specifically, each of first case 61 and second case 62 is formed as a single piece by injection molding, or the like, using a resin material.

[Power Supply Unit]

Power supply unit 70 is a power supply device for generating power for turning ON light-emitting modules 20. Power supply unit 70 converts alternating current power supplied from an external power supply such as a power supply system or a storage battery via the ceiling coupler and an adapter (not illustrated in the figures), into direct current power, and supplies the direct current power to light-emitting modules 20.

Power supply unit 70 specifically controls the turning ON (fully turned ON) and turning OFF of light-emitting modules 20. Power supply unit 70 may perform the dimming or toning of light-emitting modules 20.

For example, power supply unit 70 regulates the amount of power to supply to light-emitting modules 20 based on the illumination control signal received by wireless communication module 50. When the illumination control signal includes a turn ON command for light-emitting modules 20, power supply unit 70 supplies power to light-emitting modules 20 to thereby cause light-emitting modules 20 to turn ON. When the illumination control signal includes a turn OFF command for light-emitting modules 20, power supply unit 70 stops the supply of power to light-emitting modules 20 to thereby cause light-emitting modules 20 to turn OFF. When the illumination control signal includes a command to select a dimming rate or a color temperature for light-emitting modules 20, power supply unit 70 performs control to cause light-emitting modules 20 to emit light corresponding to the dimming rate or color temperature selected according to the command included in the illumination control signal.

As illustrated in FIG. 5 and FIG. 7, power supply unit 70 includes, for example, circuit board 71, a plurality of circuit elements 72, connector 73, and case 74. Circuit board 71 is, for example, a printed wiring board provided with metal printed wiring that electrically connects circuit elements 72 and connector 73. Circuit elements 72 consist of, for example, a rectifier circuit element, a sense resistor, a fuse element, a resistor, a capacitor, a choke coil, and a diode or a transistor.

Connector 73 is a component for electrically connecting power supply unit 70 and wireless communication module 50. Connector 73 has one end connected to circuit board 71 and has, in the other end, a male plug terminal that can be inserted into connector 54.

Case 74 is a case for housing circuit board 71 on which circuit elements 72 are mounted. Case 74 is a substantially rectangular parallelepiped-shaped (tray-shaped) case having an open main body 10-side face. Case 74 is secured to the reverse side of placement surface 11 of main body 10, using a screw.

[Advantageous Effects, Etc.]

As described above, luminaire 1 according to this embodiment includes: main body 10 having placement surface 11 on which light-emitting modules 20 (light emitter) are placed to emit light forward; and wireless communication module 50 which receives, by wireless communication, a control signal for controlling light-emitting modules 20. Wireless communication module 50 (i) includes substrate 51 and transceiver 52 which is provided on substrate 51 and receives the control signal, and (ii) is secured to main body 10 in such an orientation that transceiver 52 is located forward of main body 10 and substrate 51 intersects placement surface 11 of main body 10.

Accordingly, transceiver 52 is located forward of main body 10, and thus transceiver 52 can be exposed forward of main body 10. Therefore, even if main body 10 were to be formed from a material that does not transmit wireless signals (radio waves) such as a metal material, transceiver 52 can receive wireless signals.

Furthermore, the communication ranges of wireless communication module 50 are, for example, formed on both sides of substrate 51 with transceiver 52 as a center. For example, as illustrated in FIG. 9, wireless communication module 50 has communication ranges 55 in which receiver sensitivity intensifies in a direction orthogonal to the major surfaces of substrate 51 and weakens in a direction parallel to the major surfaces of substrate 51. As such, if substrate 51 were to be placed so as to be parallel to placement surface 11 of main body 10, only one of communication ranges 55 formed on both sides of substrate 51 can be used, and thus communication performance deteriorates.

In contrast, in this embodiment, wireless communication module 50 is secured to main body 10 in such an orientation that substrate 51 intersects placement surface 11, which thereby enables communication ranges 55 on both sides of substrate 51 to be used. In particular, when substrate 51 is orthogonal to placement surface 11, communication ranges 55 on both sides of substrate 51 can be sufficiently used, and thus communication performance can be enhanced.

Furthermore, since transceiver 52 is exposed forward of main body 10, the effect of the heat generated from light-emitting modules 20 placed on placement surface 11 can be reduced. Furthermore, as illustrated in FIG. 5, when power supply unit 70 is provided on the reverse side of placement surface 11, transceiver 52 can be distanced from power supply unit 70, and thus the effect of the heat generated by power supply unit 70 can be reduced. In this manner, it is possible to prevent the heat generated by light-emitting modules 20 and/or power supply unit 70 from being transferred to transceiver 52, and thus deterioration of communication performance can be prevented.

As described above, luminaire 1 according to this embodiment is capable of preventing deterioration of communication performance in wireless communication.

Here, forward of placement surface 11 refers to the light emission side from light-emitting modules 20. As such, the portion of wireless communication module 50 located forward of placement surface 11 may block the light emitted from light-emitting modules 20, and thus lead to deterioration of light extraction efficiency.

In response to this, in this embodiment, for example, main body 10 has through hole 10 which penetrates through placement surface 11, and wireless communication module 50 is inserted in through hole 12.

Accordingly, since wireless communication module 50 is inserted in through hole 12, the portion exposed forward of placement surface 11 can be reduced. Therefore, deterioration of light extraction efficiency can be reduced.

Furthermore, for example, substrate 51 is elongated; transceiver 52 is provided at a position closer to one end in a lengthwise direction of substrate 51; wireless communication module 50 further includes controller 53 which is (i) provided at a position closer to the other end in the lengthwise direction of substrate 51 and (ii) processes the control signal received by transceiver 52; and placement surface 11 is located between transceiver 52 and at least a portion of controller 53 in the lengthwise direction.

Accordingly, for example, it is possible to expose transceiver 52 forward of placement surface 11 and store majority of controller 53 on the reverse side of placement surface 11 (i.e., the backside of main body 10). In other words, since the portion of transceiver 52 that is exposed from placement surface 11 can be reduced as much as possible, deterioration of light extraction efficiency can be reduced.

Furthermore, for example, luminaire 1 further includes power supply unit 70 which is disposed on a reverse side of placement surface 11, and supplies power for turning ON light-emitting modules 20. Power supply unit 70 includes circuit board 71, and wireless communication module 50 is connected to circuit board 71 via connector 73.

Accordingly, by using connector 73, wireless communication module 50 can be connected to circuit board 71 of power supply unit 70. For example, a long cable, or the like, need not be used, and thus the number of components can be reduced. Furthermore, it is possible to prevent deterioration of reliability due to cable severance, etc.

Furthermore, for example, in a front view of placement surface 11: light-emitting modules 20 are ring-shaped; and wireless communication module 50 is located inward of light-emitting modules 20 that form a ring shape.

Accordingly, since wireless communication module 50 is located inward of light-emitting modules 20 which form a ring, light-emitting modules 20 are not significantly blocked. For example, when a user looks at luminaire 1 from the side, wireless communication module 50 is located at the back and at least one of light-emitting modules 20 is located at the front. As such, when light-emitting modules 20 emit light, the light from the part of light-emitting modules 20 which is at the front can be seen by the user. Therefore, deterioration of light extraction efficiency can be reduced.

Furthermore, for example, substrate 51 is orthogonal to placement surface 11, and substrate 51 has major surfaces lying along a radial direction of light-emitting modules 20 that form a ring shape.

Accordingly, since substrate 51 is orthogonal to placement surface 11, the communication ranges on both sides of substrate 51 can be sufficiently used, and thus communication performance can be enhanced. Furthermore, since the major surfaces of substrate 51 lie along a radial direction of light-emitting modules 20, deterioration of light extraction efficiency can be reduced.

[Others]

Although a luminaire according to one or more aspects of the present invention has been described based on an exemplary embodiment up to this point, the present invention is not limited to the foregoing embodiment.

For example, although in the foregoing embodiment an example is given in which the light emitter (light-emitting modules 20) is provided in the shape of a ring and wireless communication module 50 is placed inward of the ring in a plan view, the present invention is not limited to such. For example, light-emitting modules 20 may be provided so as to fill the entirety of a circular or square area. In this case, wireless communication module 50 may be placed outward of light-emitting modules 20, specifically, in an area located along the circumference of light-emitting modules 20 in the front view.

Furthermore, for example, although in the foregoing embodiment an example is given in which wireless communication module 50 is inserted in through hole 12 which penetrates through placement surface 11, the present invention is not limited to such. For example, wireless communication module 50 may be secured to a recess provided in main body 10. Furthermore, for example, wireless communication module 50 may be provided in periphery portion 13 provided along the outer circumference of placement surface 11. As illustrated in FIG. 6, etc., since periphery portion 13 is located backward of placement surface 11, the portion of wireless communication module 50 that projects forward of placement surface 11 is reduced. Therefore, blocking of light by wireless communication module 50 can be reduced, and thus deterioration of light extraction efficiency can be reduced.

Furthermore, for example, although in the foregoing embodiment an example is given in which substrate 51 of wireless communication module 50 is elongated, the present invention is not limited to such. For example, the shape of the major surfaces of substrate 51 may be square or circular. Transceiver 52 and controller 53 may be placed side-by-side on a major surface of square-shaped substrate 51. In this case, wireless communication module 50 may be secured to main body 10 in such an orientation that transceiver 52 is located downward (i.e., on the light emission side) of controller 53.

Furthermore, for example, although in the foregoing embodiment an example is given in which wireless communication module 50 has transmitting and receiving functions, the present invention is not limited to such. For example, wireless communication module 50 may have only a signal receiving function, and need not have a transmitting function. Specifically, wireless communication module 50 may include, in place of transceiver 52, a receiver that performs only the reception of wireless signals.

Furthermore, for example, although in the foregoing embodiment an example is given in which light-emitting modules 20 include LEDs, the present invention is not limited to such. For example, light-emitting modules 20 may include organic electroluminescent (EL) elements or laser elements, etc.

Furthermore, for example, although in the foregoing embodiment an example is given in which luminaire 1 is a ceiling light, the present invention is not limited to such. For example, luminaire 1 may be a down light or a pendant light, etc.

Forms obtained by various modifications to the embodiments that can be conceived by a person of skill in the art as well as forms realized by arbitrarily combining structural components and functions in the embodiments which are within the scope of the essence of the present invention are included in the present invention.

What is claimed is:

1. A luminaire comprising:

a main body having a placement surface on which a light emitter is placed to emit light forward; and a wireless communication unit which receives, by wireless communication, a control signal for controlling the light emitter, wherein the wireless communication unit (i) includes:
a substrate; and
a receiver which is provided on the substrate and receives the control signal, and
(ii) is secured to the main body in such an orientation that the receiver is located forward of the main body and the substrate intersects the placement surface of the main body,
the main body has a through hole penetrating the placement surface, and
the wireless communication unit is inserted in the through hole.

2. The luminaire according to claim 1, wherein
the substrate is elongated,
the receiver is provided at a position closer to one end of the substrate in a lengthwise direction of the substrate,
the wireless communication unit further includes a controller which (i) is provided at a position closer to the other end of the substrate in the lengthwise direction and (ii) processes the control signal received by the receiver, and
the placement surface is located between the receiver and at least a portion of the controller in the lengthwise direction.

3. The luminaire according to claim 2, further comprising:
a power supply unit which is disposed on a reverse side of the placement surface, and supplies power for turning ON the light emitter, wherein
the power supply unit includes a circuit board, and
the wireless communication unit is connected to the circuit board via a connector.

4. The luminaire according to claim 1, wherein
in a front view of the placement surface:
the light emitter is ring-shaped; and
the wireless communication unit is located inward of the light emitter that is ring-shaped.

5. The luminaire according to claim 4, wherein
the substrate is orthogonal to the placement surface, and
the substrate has major surfaces lying along a radial direction of the light emitter that is ring-shaped.

* * * * *